US011391140B2

(12) United States Patent
Nordsveen et al.

(10) Patent No.: US 11,391,140 B2
(45) Date of Patent: Jul. 19, 2022

(54) RISER SURGE PROTECTION SYSTEM

(71) Applicant: EQUINOR ENERGY AS, Stavanger (NO)

(72) Inventors: Magnus Nordsveen, Fjærdingby (NO); Tor Kindsbekken Kjeldby, Stavanger (NO); Håvard Eidsmoen, Oslo (NO); Arne Valle, Porsgrunn (NO)

(73) Assignee: EQUINOR ENERGY AS, Stavanger (NO)

( * ) Notice: Subject to any disclaimer, the term of this patent is extended or adjusted under 35 U.S.C. 154(b) by 97 days.

(21) Appl. No.: 16/755,469

(22) PCT Filed: Oct. 12, 2018

(86) PCT No.: PCT/NO2018/050244
§ 371 (c)(1),
(2) Date: Apr. 10, 2020

(87) PCT Pub. No.: WO2019/074376
PCT Pub. Date: Apr. 18, 2019

(65) Prior Publication Data

US 2021/0222527 A1 Jul. 22, 2021

(30) Foreign Application Priority Data

Oct. 12, 2017 (GB) ..... 1716719
Jul. 13, 2018 (GB) ..... 1811556

(51) Int. Cl.
*E21B 43/12* (2006.01)
*E21B 43/38* (2006.01)
(Continued)

(52) U.S. Cl.
CPC ..... *E21B 43/38* (2013.01); *E21B 17/01* (2013.01); *E21B 17/20* (2013.01); *E21B 43/121* (2013.01); *E21B 47/06* (2013.01)

(58) Field of Classification Search
CPC ..... E21B 43/38; E21B 43/121; E21B 43/01; E21B 43/13; E21B 17/01; E21B 17/20; E21B 47/06; E21B 37/00
See application file for complete search history.

(56) References Cited

U.S. PATENT DOCUMENTS 4,926,937 A * 5/1990 Hademenos ..... E21B 23/01 166/206
5,033,545 A 7/1991 Sudol
(Continued)

FOREIGN PATENT DOCUMENTS

WO WO 98/28519 A1 7/1998
WO WO 2004/044370 A2 5/2004
(Continued)

OTHER PUBLICATIONS

International Search Report for PCT/NO2018/050244 dated Dec. 19, 2018.
(Continued)

*Primary Examiner* — Giovanna Wright
*Assistant Examiner* — Yanick A Akaragwe
(74) *Attorney, Agent, or Firm* — Birch, Stewart, Kolasch & Birch, LLP

(57) ABSTRACT

A system for surge protection of a riser adapted to transport gas from a hydrocarbon production well or for surge protection in a well, the system comprising: a flexible tubing, wherein a portion of the flexible tubing extends into the riser or into the well and wherein the tubing terminates inside the riser or inside the well; a pressure control system arranged to create a pressure differential within the flexible tubing such that liquid is drawn from the riser or the well into the flexible tubing if liquid is present in the riser or the well;
(Continued)

wherein the length of said portion of the flexible tubing is variable depending on the amount of liquid drawn into the flexible tubing.

34 Claims, 7 Drawing Sheets

(51) Int. Cl.

| | |
|---|---|
| ***E21B 17/20*** | (2006.01) |
| ***E21B 17/01*** | (2006.01) |
| ***E21B 47/06*** | (2012.01) |

(56) References Cited

U.S. PATENT DOCUMENTS

| | | | |
|---|---|---|---|
| 5,904,209 | A | 5/1999 | Kenworthy et al. |
| 2003/0010204 | A1 | 1/2003 | Molyneux et al. |
| 2005/0045332 | A1 | 3/2005 | Howard et al. |
| 2006/0150749 | A1 | 7/2006 | Eken et al. |
| 2007/0169933 | A1 | 7/2007 | Heller et al. |
| 2010/0155075 | A1 | 6/2010 | Holm |
| 2012/0067569 | A1 | 3/2012 | Brown |
| 2013/0098629 | A1* | 4/2013 | Wilson ..... E21B 17/203 166/372 |
| 2013/0327535 | A1 | 12/2013 | Lamison |
| 2015/0204169 | A1 | 7/2015 | Coates et al. |
| 2016/0215587 | A1 | 7/2016 | Vavik |
| 2016/0319653 | A1 | 11/2016 | Reeves et al. |

FOREIGN PATENT DOCUMENTS

| | | | |
|---|---|---|---|
| WO | WO 2016/057126 A1 | 4/2016 | |
| WO | WO-2016130623 A1 * | 8/2016 | ..... B66D 3/04 |

OTHER PUBLICATIONS

Priority Search Report for GB1716719.8 dated Feb. 20, 2018.
Priority Search Report for GB1811556.8 dated Jul. 31, 2018.
Written Opinion of the International Searching Authority for PCT/NO2018/050244 dated Dec. 19, 2018.
Extended European Search Report for European Application No. 18865782.9, dated May 26, 2021.
British Search Report for British Application No. GB1811556.8, dated Jun. 15, 2020.

* cited by examiner

RISER SURGE PROTECTION SYSTEM

The invention relates to controlling the flow of hydrocarbons in a pipe, a flowline or a riser and in particular to riser surge protection.

A hydrocarbon producing flowline can be connected to a riser which transports gas and liquids from the well to a production facility. The flowline and riser can be connected to each other at a connection point. Alternatively, the flowline and riser can both be part of a single tubular, whereby the part of the tubular which extends upwards towards the surface is referred to as the riser. A challenge for a gas-condensate transport flowline may be liquid surging, especially for wells which are at a late stage of the life cycle. Liquid surging includes periodic accumulation and periodic movement of fluid in the riser. The gas velocity at a late stage of the life cycle will be lower than at an earlier stage, which contributes to fluids accumulating in the flowline and in the riser. At some point, the accumulated liquid film on the walls of the riser may start to flow towards a riser base in an unstable manner, giving rise to liquid accumulation at the riser base and pulsating liquid production at the platform. This is known as liquid surging. At some point, liquid surging may become so severe that overfilling of separators can occur, which in turn causes problems for processing plants and may ultimately make it necessary to abandon the flowline. Effective and cheap methods for liquid surging mitigation are therefore desirable.

According to a first aspect of the invention, there is provided a system for surge protection of a riser adapted to transport gas from a hydrocarbon production well or for surge protection in a well, the system comprising: a flexible tubing, wherein a portion of the flexible tubing extends into the riser or into the well and wherein the tubing terminates inside the riser or inside the well; a pressure control system arranged to create a pressure differential within the flexible tubing such that liquid is drawn from the riser or the well into the flexible tubing if liquid is present in the riser or the well; wherein the length of said portion of the flexible tubing is variable depending on the amount of liquid drawn into the flexible tubing.

The system may further comprise a reel for storing a further portion of the flexible tubing and for varying the length of said portion of the flexible tubing extending into the riser.

The system may further comprise a pressure sensor arranged to measure the pressure in the flexible tubing, and optionally, a control system arranged to increase the length of said section if the pressure in the tubing is below a first threshold level and arranged to decrease the length of said section if the pressure in the tubing is above a second threshold level. The first threshold level and the second threshold level can be the same, or the second threshold level can be higher than the first threshold level.

The system may further comprise a detector arranged to detect the presence of fluid or amount of fluid in the flexible tubing. The system may further comprise a control system arranged to: increase the length of said section if the amount of detected fluid is below a first threshold level, or if no fluid is detected; the control system further arranged to: decrease the length of said section if the amount of detected fluid is above a threshold.

Optionally, the pressure control system comprises a low pressure tank and a valve, and wherein the pressure in the low pressure tank is lower than the pressure within the riser at the section where the flexible tubing terminates. The pressure control system may comprise a pump.

The system may further comprise a return system for returning fluid extracted by the flexible tubing back to the production process, and, optionally the return system comprises a multiphase pump. The pressure control system may comprise a separator connected to said flexible tubing, and the riser may be connected to a further separator and the further separator may have a lower pressure than the separator connected to the flexible tubing.

The system may further comprise a spacer arranged to urge the end of the flexible tubing against an inner wall of the riser and/or a weight arranged to urge the end of the flexible tubing against an inner wall of the riser.

According to a second aspect of the invention, there is provided a method for protecting a riser adapted to transport gas from a hydrocarbon production well against pressure surges or for protecting a well against pressure surges, the method comprising: extending a portion of a flexible tubing into the riser or into the well, wherein the tubing terminates inside the riser or the well; drawing liquid from the riser or well into the flexible tubing if liquid is present in the riser or well by creating a pressure differential within the flexible tubing with a pressure control system; varying the length of said portion of the flexible tubing depending on the amount of liquid drawn into the flexible tubing.

The step of said varying may comprise rolling or unrolling the flexible tubing on a reel. The method may further comprise determining the pressure within the flexible tubing and varying the length depending on said determining. The method may further comprise determining the amount of liquid within the flexible tubing and varying the length depending on said determining. The step of drawing of liquid may comprise regulating a valve to a low pressure reservoir. The step of drawing of liquid may comprise controlling a pump. The method may additionally comprise transporting fluid from the flexible tubing to a production facility.

The method may further comprise connecting said riser to a first separator and connecting said flexible tubing to a further separator, wherein the pressure of the further separator is lower than the pressure of the first separator. The method may further comprise urging the end of the flexible tubing against an inner wall of the riser.

Further optional features are set out in the accompanying dependent claims.

Some embodiments of the invention will now be described by way of example only and with reference to the accompanying drawings, in which.

Figure 7A:
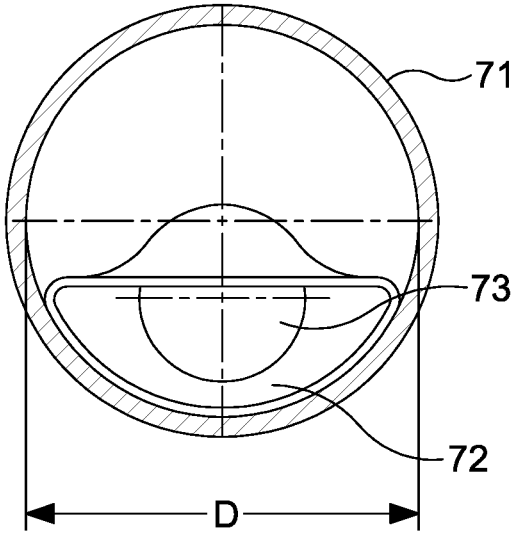
Figure 7B:
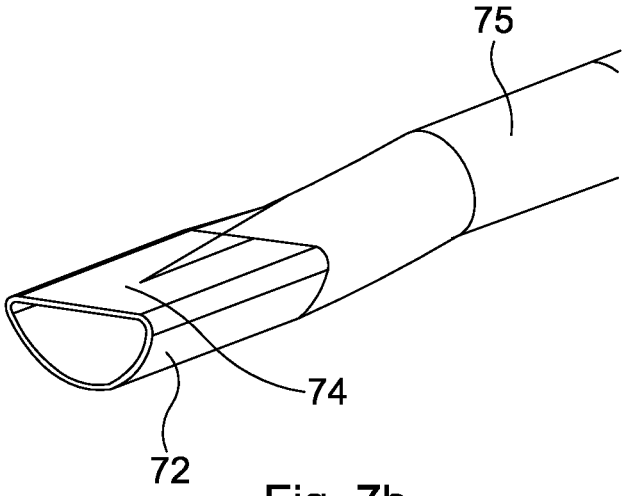

FIG. 7*a* is a radial cross section through a riser with an intake device, and FIG. 7*b* is a perspective view of an intake device and tubing.

Herein disclosed is a system which can be used for protecting a riser and production facility against liquid surges. The riser is used for transporting gas and liquid from a flowline located at the sea bed to a production facility. The riser contains liquid and gas and at low gas flow rates the liquid may accumulate and move in a wave-like manner downstream. Flexible tubing is provided which extends partially into the riser and which ends inside the riser. A pressure differential within the flexible tubing is provided such that any liquid in the area where the tubing ends is drawn into the flexible tubing and is transported up. The liquid can be transported to a container which is kept at a lower pressure than the area within the riser where the tubing ends. The amount of liquid which is drawn into the tubing can be controlled by a regulating valve provided between the tubing and the container. Alternatively, a pump can be provided which controls the amount of liquid drawn into the flexible tubular.

The riser will in a typical arrangement not only extend upwards continually from the flowline in a straight way, but the riser will have several areas with bends and local dips where fluids can accumulate. The end of the flexible tubular can be placed in such a bend or a local dip to draw the liquid out of that area. By removing the liquid from the riser a surge of liquid in which collected liquid suddenly moves upwards can be prevented. If the amount of liquid accumulating in one area is large enough to take up the entire cross sectional area then a liquid plug can be formed which blocks the flow of gas and causes fluctuations of pressure. The flexible tubing can be extended into the plug such that the plug of liquid can be removed by suction from the flexible tubing.

However, also without local depressions of the riser where liquid can accumulate as a plug there can be a problem of liquid surging. Gas condensate typically accumulates along the walls of the riser while the central area of the riser remains free for gas to flow through. By way of example, liquid condensate along the walls can occupy from 5% to 20% of the cross sectional area. This problem occurs also in risers which extend continuously upwards. The liquid will move upwards under the influence of the upwards gas flow through the centre of the riser. The upwards movement of the liquid is not a stable process due to the opposite forces of gravity and friction of the riser walls, and the instability causes waves of liquid and liquid surging instead of a steady flow. The flexible tubing is used to remove the liquid to reduce the cross sectional area taken up by fluid and to reduce the overall amount of fluid, thereby mitigating the liquid surging.

The end of the flexible tubing within the riser is preferably in contact with the riser walls, especially when gas flows through the centre of the riser and gas condensate is accumulated along the walls. Various mechanical means can be provided for urging the tubing against the riser inner walls. One option can be a heavy weight or inlet device which is attached to the end of the flexible tubing and which urges the end of the flexible tubing towards the lowest part of the riser. This example of a heavy weight or inlet device works best if the riser has a significant horizontal component. Another example is a spacer which extends from the flexible tubing to the opposite internal riser wall to urge the flexible tubing against the riser wall. Examples of spacers are simple mechanical devices such as a mechanical spring or extendable rod. Optionally, the spacers can be activated remotely but that will require communication lines and control units which will add costs to the setup.

In a specific embodiment, the portion of the flexible tubing which is outside the riser is stored on a reel which can also be used to vary the length of the portion of the flexible tubing extending into the riser. The length of the portion of the tubing extending into the riser can also be actively controlled by a feedback system depending on a detected amount of fluid in the flexible tubing. When a larger amount of fluid is present, the flexible tubing can be pulled up by rolling up the reel or by any other lifting mechanism. Alternatively, the tubing can be left in place if a large amount of fluid is detected within the tubing. If a small amount of fluid or no fluid is detected inside the flexible tubing, the tubing can be extended to reach further into the riser and remove liquid at a section of the riser closer to the well. This feedback system can be automated and be controlled by a computing system, or it can be carried out manually. The active control system enables continuous lifting of the gas and liquid mixture from the riser base to the topside.

The variable length of the flexible tubing can also be utilised to initiate the flow within the flexible tubing. The pressure differential required for starting the flow of a large amount of fluid from a location low in the riser can be relatively large. The required pressure differential can be reduced by raising the intake point of the flexible tubing for starting the flow, and lowering the intake point after the flow has started to the desired location.

Different methods can be used for detecting the presence of fluids in the flexible tubing, such as standard optical or acoustic methods, or a gamma densitometer clamped onto the coiled tubing topside. Alternatively, the pressure within the flexible tubing near the control valve can be detected, and a drop in pressure will indicate an increase of the amount of gas and a decrease of the amount of fluid.

An advantage of this arrangement is that it will be efficient to implement on platforms with coiled tubing equipment already in place. At such a platform, coiled tubing is connected to an available low-pressure tank via a control valve. This allows for drawing liquid up from the riser base. The optimal pressure in the low-pressure tank depends on the depth of the riser base and the pressure within the riser. The pressure difference between riser base process and the low-pressure tank determines the driving potential for the liquid extraction.

A plurality of separators can be used in stage separation of the hydrocarbons. The first separator, called the first-stage separator, typically has the highest pressure and the operating pressure is sequentially reduced in each successive separator. The flexible tubing will be able to carry out a suction function if the pressure inside the flexible tubing is lower than the pressure inside the riser. This pressure difference can be achieved by connecting the flexible tubing to a separator which has a lower pressure than the nearest separator to which the riser is connected. In one example, the riser section is directly connected to a first-stage separator, and the flexible tubing is connected to a second-stage separator.

A variable pressure differential can be applied to the flexible tubing, for example with a pump or with pressure control facilities provided at the separator. The variable length of the flexible tubing and the variable pressure provide two controls which can be used together or independently to control the intake of fluids into the flexible tubing.

The flexible tubing can be installed for surge protection within a riser. Alternatively, the flexible tubing can be installed inside the tubing in a gas-condensate well. Gas-condensate wells may also become unstable and ultimately need to be abandoned due to liquid accumulation. The methods described herein are applicable to a well and the hydrodynamics are similar when compared to a riser. However, if the well has its well head located at the sea bed there may not be a low pressure separator or a high pressure separator available for connection to the coiled tubing well-head-end and well head tubing, respectively. In such a setup, the well-head-end of the coiled tubing could be connected to a low pressure subsea flowline, while the well tubing could be connected to a separate flowline located at a higher pressure. If the well head is located above sea level, i.e. on a well head platform, coiled tubing and well tubing could be connected to low pressure and high pressure separators respectively, as described for a riser setup. In some gas-condensate wells the major portion of liquid to be removed deep in the well is liquid which flows downwards from an upper part of the well due to condensation in the upper part of the well. In an embodiment described in more detail below, the intake device is designed differently to capture the condensing liquid flowing downward instead of being designed to capture liquid flowing upwards from the reservoir.

One particular example of flexible tubing for gas-liquid flow is coiled tubing. A suitable coiled tubing diameter is selected to optimise the amount of liquid being extracted while minimising the amount of gas being taken into the coiled tubing. If a thin layer of liquid is present along the walls then a corresponding small-diameter coiled tubing is selected. If the tubing is connected to a low pressure tank that is not part of the regular separation process (such as a second or higher stage separator), then the extracted gas and liquid mixture is pumped back into the process using a small multiphase pump. If the gas flow rate in the flexible tubing is too high for a multiphase pump, then a small compressor is used in parallel to a separate liquid pump. If the output of the coiled tubing is connected directly to a second or third stage separator no pump or compressor will be required, but only a control valve.

The flexible tubing allows for a pigging operation by simply extracting the flexible tubing from the riser completely and returning the flexible tubing after the operation has been completed.

Figure 1:
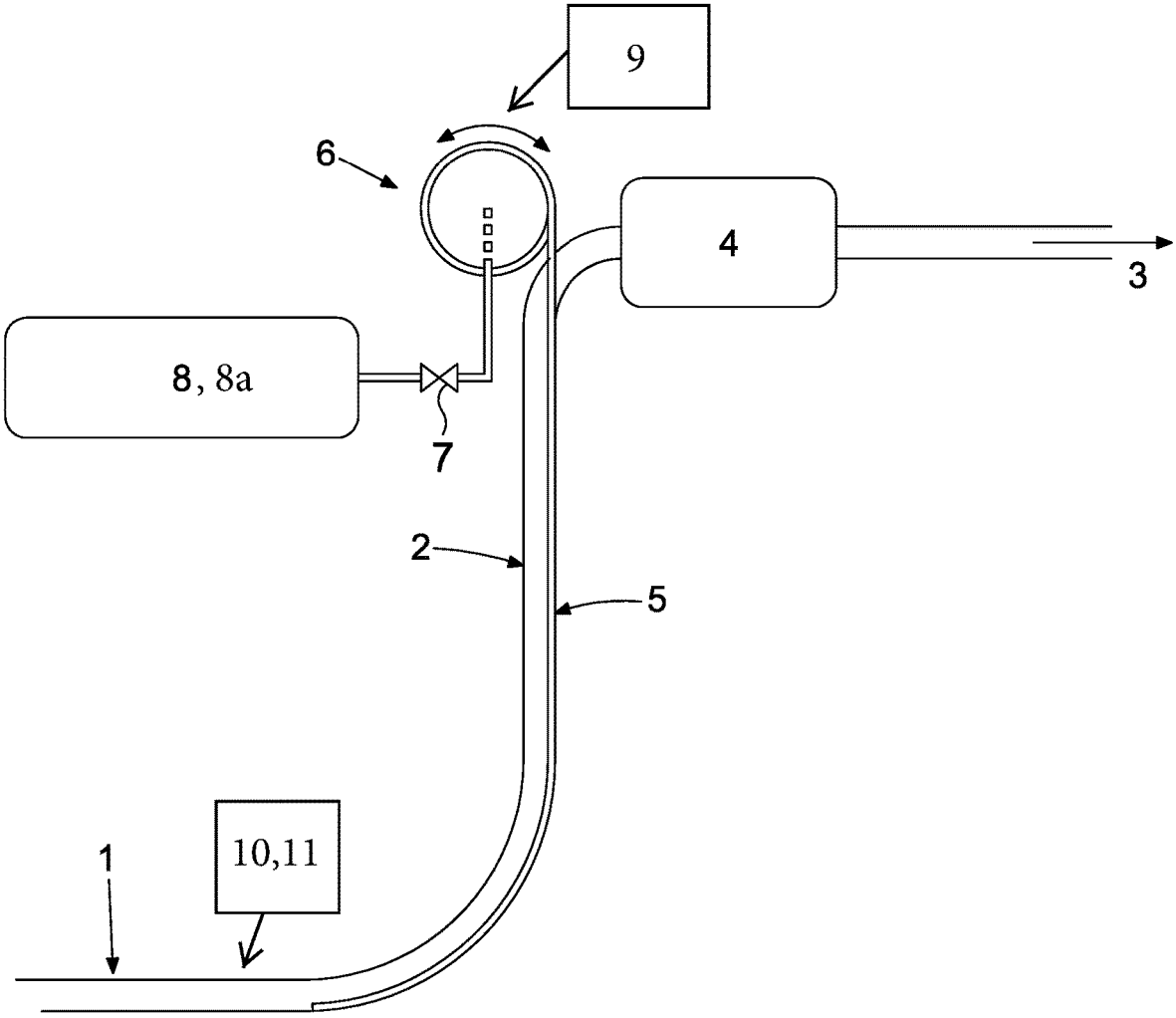
FIG. 1 illustrates a surge protection system.

FIG. 1 illustrates a flowline 1 and a riser 2 which carry gas and liquids in a direction 3 towards a processing facility. A first stage separator 4 is used. The pressure at the first stage separator is 20 Bar(a). A coiled tubing 5 extends into the riser and is arranged to draw fluid from the lowest part of the riser 2. The coiled tubing 5 is provided on a reel 6 outside the riser. The reel 6 can be used to wind and unwind the coiled tubing, corresponding respectively to reducing and extending the amount of the coiled tubing extending into the riser 2. A valve 7 controls the flow of fluid from the coiled tubing towards a low pressure tank 8, which can include a multiphase pump 8*a*. The low pressure tank is kept at a pressure of around 2 Bar(a), while the pressure at first stage separator 4 is 20 Bar(a). The fluid is pumped from the low pressure tank to a further part of the process, such as a second stage separator (not illustrated). Alternatively, low pressure tank 8 can be a separator, such as a $2^{nd}$ stage, a $3^{rd}$ stage or higher stage separator.

In FIG. 1, a control system 9 is arranged to increase the length of the portion of the flexible tubing extending into the riser or well, if the pressure in the flexible tubing is below a first threshold level, and arranged to decrease the length of said portion if the pressure in the tubing is above a second threshold level. A return system 10, which can include a multiphase pump 11, can be provided for returning fluid extracted by the flexible tubing 5 back to the production process.

Figure 2:
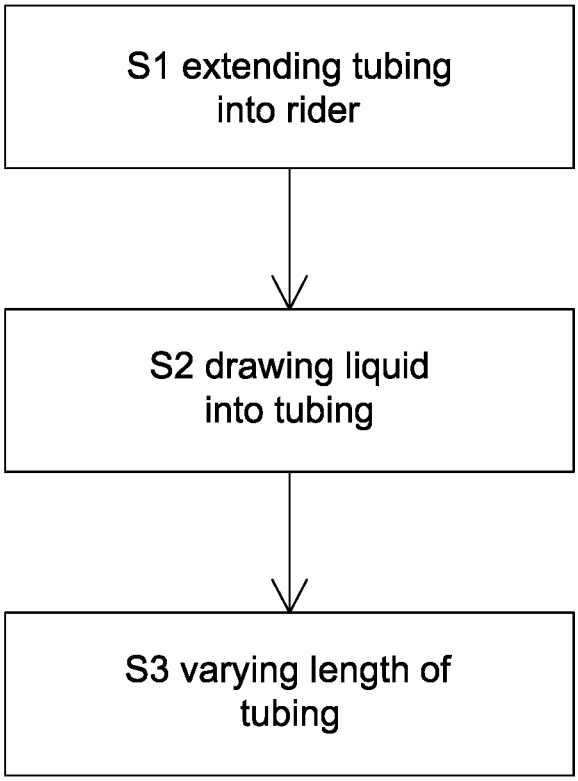
FIG. 2 illustrates a method.

FIG. 2 illustrates a method disclosed herein. The method includes the steps of: S1, extending a portion of flexible tubing into the riser; S2, drawing liquid from the riser into the flexible tubing if liquid is present in the riser by creating a pressure differential within the flexible tubing with a pressure control system; and S3, varying the length of said portion of the flexible tubing depending on the amount of liquid drawn into the flexible tubing.

The system described herein allows for reduction of the risk of a surge wave formation. The system can be used to extend the lifetime of gas-condensate fields. Without proper methods for surge mitigation, flowlines may need to be abandoned due to severe surge instabilities. Being able to efficiently remove liquid from the flowlines by way of the present system prevents surge instabilities partly or completely, thereby enabling continued production.

Figure 3:
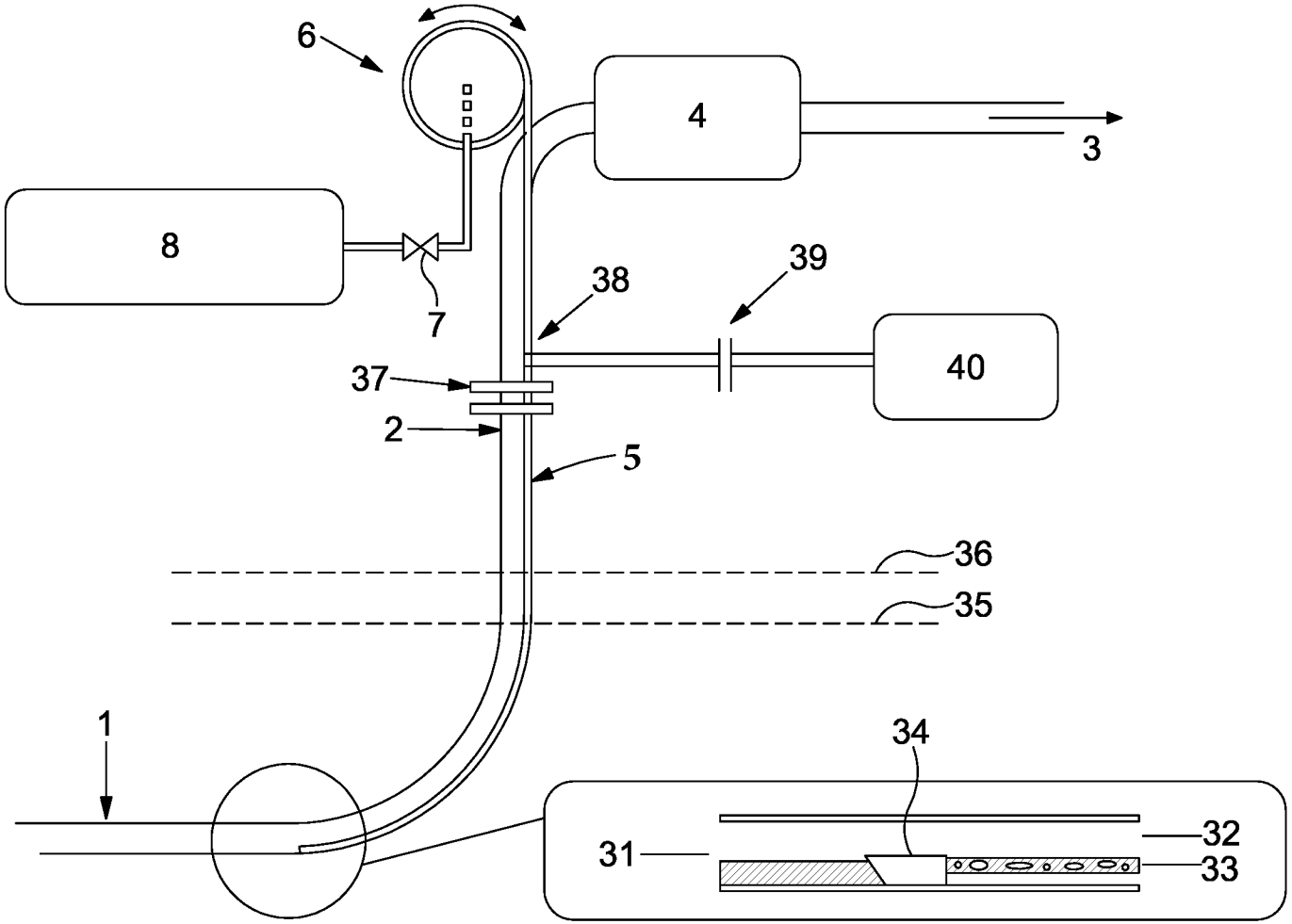
FIG. 3 illustrates a surge protection system.

In some embodiments it is beneficial to terminate the coiled tubing at a topside location and hang off the coiled tubing in a coiled tubing hanger arrangement placed inside the riser. FIG. 3 illustrates an arrangement similar to the arrangement of FIG. 1, wherein the same reference numbers are used for the same features. The inset illustrates schematically a flow 31 within flowline 1 wherein the flow includes gas and a liquid condensate against the lower inner surface. A gas flow 32 will enter the riser and a mixture of gas and liquid 33 will flow upwards within flexible tubing. Line 35 illustrates the interface between the sea level and an air gap, while line 36 illustrates the interface between the airgap and the topside. A connection 37 is provided which connects the riser 2 to the topside piping. At a position along the topside piping indicated with arrow 38 the flexible tubing is cut and the section of flexible tubing above arrow 38 is removed. A pipe exits the topside piping towards control unit 40, which may include low pressure tank 8 (in which case elements 8 and 40 in FIG. 3 would be combined) or a different pressure control device. This arrangement enables use of the coiled tubing system without routing the gas-liquid mixture lifted from the riser via the reel. The arrangement without the reel has fewer components and has a reduced risk of leaks when compared to a system with a reel, and is therefore more likely to be approved as a permanent part of a production system. The initial arrangement can then also be set up using a reel located on a ship. When the flexible tubing has been inserted into the riser, the flexible tubing can be terminated topside and can be attached to the tubing, referred to as 'hanged off', and the ship can sail away with the reel. When the length of the flexible tubing is fixed, the amount of liquid being drawn into the flexible tubing can be controlled by setting the pressure inside the flexible tubing. A choke valve to a higher stage separator can be used to set the pressure, or the speed of a multiphase pump can be used as a control parameter.

Figure 4:
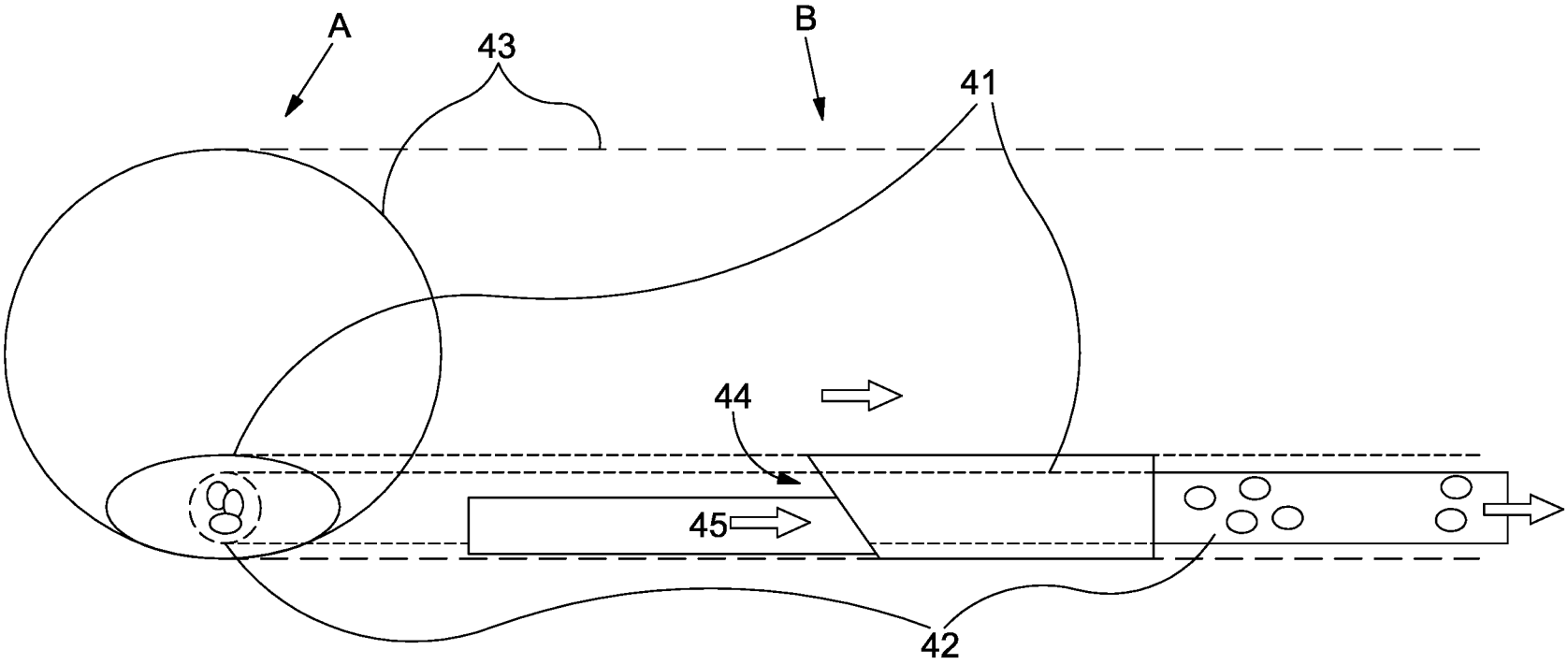
FIG. 4 illustrates a surge protection system.

FIG. 4 illustrates a specific embodiment of an intake device in more detail. The intake device 41 is attached to the end of the flexible tubing 42. The flexible tubing can be coiled tubing. Part A of FIG. 4 is a cross section in radial direction of the riser and part B is a cross section of the riser (or flowline) 43 in axial direction. As shown in part A, the cross section of the intake device in radial direction shows an oval shape such that the area in which the intake device is in contact with the inside wall of the riser is larger than if the intake device had a circular cross section like the flexible tubing 42. Single phase gas flows through the riser and partially into the intake device as illustrated with arrows 44. A liquid film is drawn into the intake device as indicated by arrow 45. The flexible tubing will contain a mixture of gas and liquid. The intake device of the illustrated embodiment is urged against the lower inside wall of the riser by the weight of the intake device. A specific example of the weight of the intake device is 100 kg for a 40 cm internal diameter riser. The connection between the flexible tubing and the intake device may be a swivel connection to allow the assembly to move past bends, or alternatively the connection may be a fixed connection.

Figure 5:
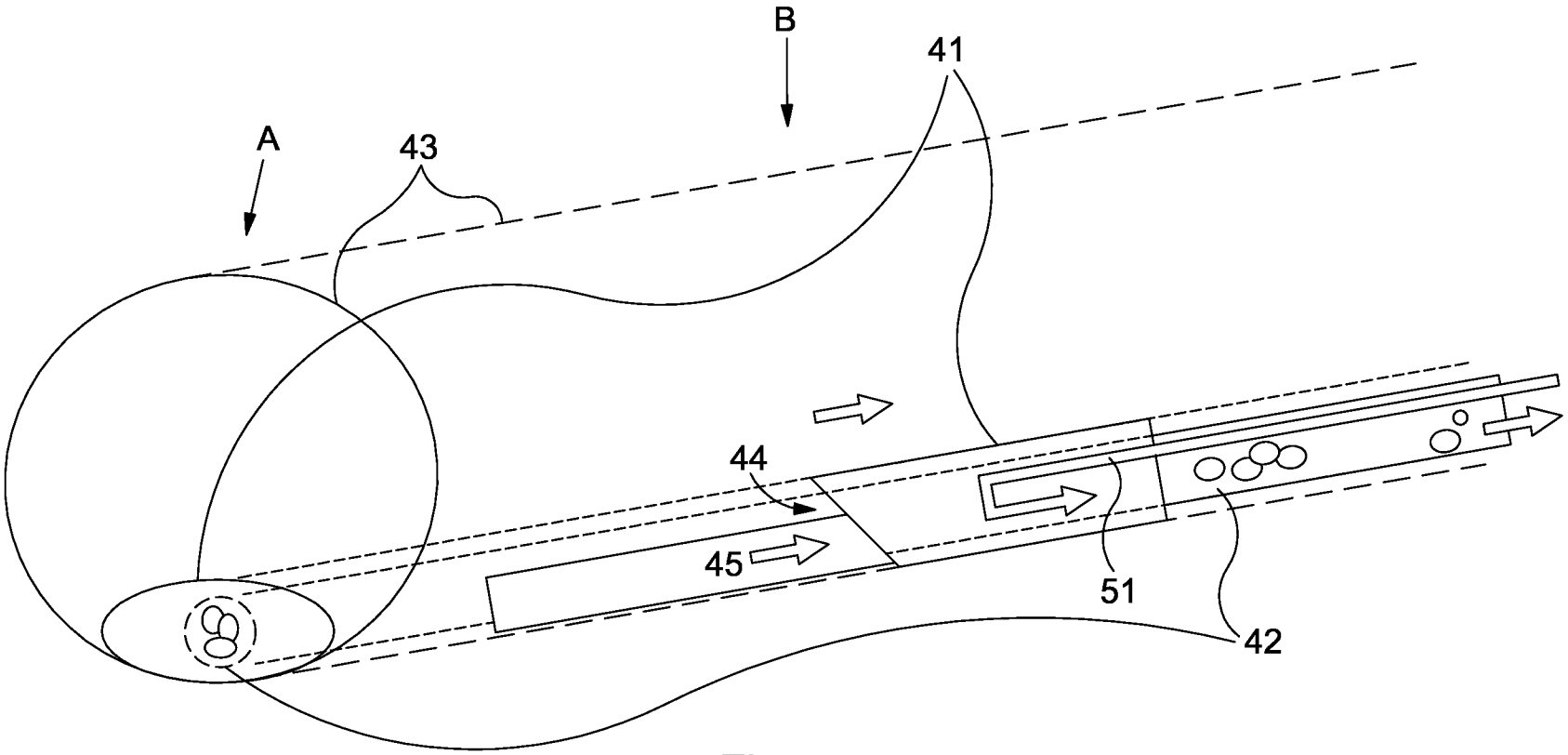
FIG. 5 illustrates a surge protection system.

FIG. 5 illustrates a further embodiment. The same reference numbers as those in FIG. 4 correspond to the same components as described previously. The methods disclosed herein could also be used in deep water risers, or within a well, where the pressure differential between a high pressure tank, such as tank 4 in FIG. 3, and a low pressure tank, such as tank 8 or device 40 in FIG. 3, at the topside is not sufficient to lift a single phase liquid all the way from the sea bed to the topside within the flexible tubing. The suction as a result of the pressure differential may not be sufficiently strong to transport the liquid upwards over a long distance. If the suction is not sufficient, gas lift could be used to start the flow of liquid within the flexible tubing. FIG. 5 illustrates a gas nozzle 51 arranged within the flexible tubing and terminating within or near the intake device 41 such that gas flow can be provided to start the flow into the flexible tubing or to support continuous flow within the flexible tubing. The lift gas can be sent from the topside (or well head) using concentric coiled tubing (i.e. pipe-in-pipe) on a coil. Alternatively, parallel strings of regular coiled tubing bound together side by side can be used.

Figure 6:
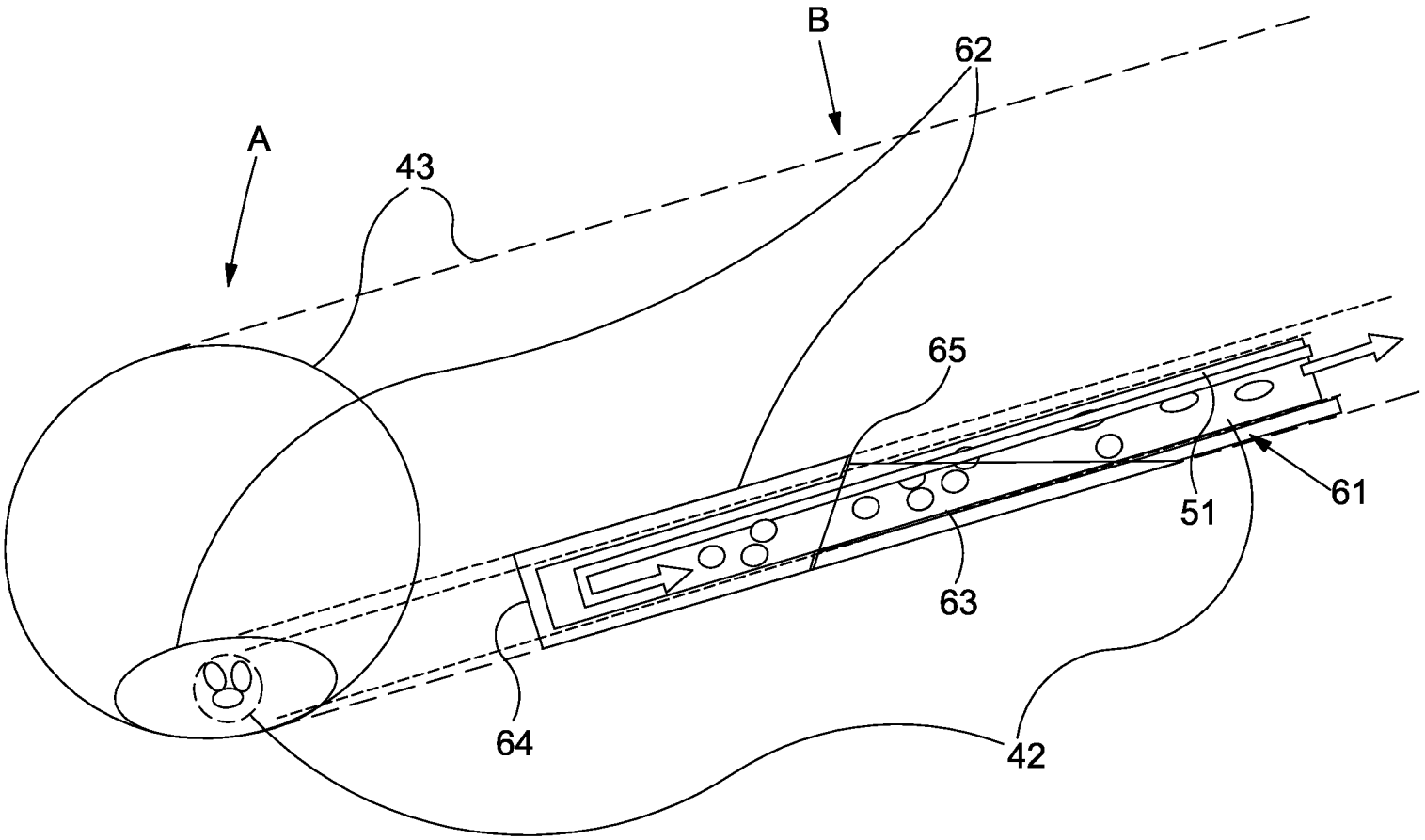
FIG. 6 illustrates a surge protection system.

FIG. 6 illustrates a further embodiment. The same reference numerals as in FIGS. 4 and 5 correspond to the same components. The flow of liquids is now different from the flow illustrated in FIGS. 4 and 5. The liquid 61 flows downwards within the pipe section above the intake device 62. The intake device is shaped such that the downwards flow is captured and channelled into the flexible tubing. Liquid accumulates above the inflow device as illustrated by shaded area 63 before being pumped upstream by the pressure differential. The end portion 64 of the intake device facing downwards is closed while the end portion 65 of the intake device facing upwards is open to receive the fluid.

FIG. 7*a* illustrates a radial cross section through a riser 71 in which an intake device 72 and flexible tubing 73 are provided. FIG. 7*b* illustrates a perspective view of the intake device and flexible tubing. As illustrated, intake device is biased against the inner wall of the riser by gravity. The lower part of the intake device has curvature which matches the curvature corresponding to inner diameter D of the riser. As a result, the lower part of the intake device is flush with the inner wall of the riser. A fluid film which is present at the lower part of the riser will be drawn into the intake device when the flexible tubing is at a lower pressure than the riser. The upper part 74 of the intake device is flat so as to reduce the amount of gas which is drawn into the flexible tubing. The upper part of the can also have other shapes than the flat shape illustrated in FIGS. 7*a* and 7*b*, for example a convex or concave shape.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A system for surge protection of a riser adapted to transport gas from a hydrocarbon production well or for surge protection in a well, the system comprising:

a flexible tubing, wherein a portion of the flexible tubing extends into the riser or into the well and wherein the flexible tubing terminates inside the riser or inside the well, wherein an end of the flexible tubing is attached to an intake device, wherein, the intake device terminates at an end portion, the end portion of the intake device comprising a partially tubular outer wall; and the outer curvature of the partially tubular outer wall matches the inner curvature of the inside wall of the riser or well; and a pressure control system arranged to create a pressure differential within the flexible tubing such that liquid is drawn from the riser or the well into the flexible tubing if liquid is present in the riser or the well.

2. The system of claim 1, wherein the surge comprises a liquid film accumulated against an inner wall of the riser or the well;

wherein the pressure control system comprises a pressure communication channel between the riser or the well and a first stage separator, and a pressure communication channel between the flexible tubing and a device with a lower pressure than the first stage separator; and wherein in use the partially tubular outer wall is biased against the inside wall of the riser or the well.

3. The system of claim 2, wherein the device with a lower pressure than the first stage separator comprises one or more of:

a low pressure tank and a valve;

a second or higher stage separator.

4. The system of claim 1, further comprising a reel for storing a further portion of the flexible tubing and for varying the length of said portion of the flexible tubing extending into the riser or into the well.

5. The system of claim 1, further comprising a pressure sensor arranged to measure the pressure in the flexible tubing.

6. The system of claim 5, further comprising a control system arranged to increase the length of the portion of the flexible tubing extending into the riser or well if the pressure in the flexible tubing is below a first threshold level and arranged to decrease the length of said portion if the pressure in the tubing is above a second threshold level.

7. The system of claim 6, wherein the first threshold level and the second threshold level are the same, or wherein the second threshold level is higher than the first threshold level.

8. The system of claim 1, further comprising a detector arranged to detect the presence of fluid or amount of fluid in the flexible tubing.

9. The system of claim 8, further comprising a control system arranged to:

increase the length of the portion of the flexible tubing extending into the riser or well if the amount of detected fluid is below a first threshold level, or if no fluid is detected; the control system further arranged to:

decrease the length of said portion if the amount of detected fluid is above a threshold.

10. The system of claim 1, wherein the pressure control system comprises a multiphase pump.

11. The system of claim 1, wherein the pressure control system comprises a first connection between the well and a first flowline and a second connection between the flexible tubing and a second flowline, and wherein the pressure in the first flowline is higher than the pressure in the second flowline.

12. The system of claim 1, further comprising a return system for returning fluid extracted by the flexible tubing back to the production process.

13. The system of claim 12, wherein the return system comprises a multiphase pump.

14. The system of claim 1, wherein said pressure control system comprises a separator connected to said flexible tubing.

15. The system of claim 14, wherein the riser or well is connected to a further separator and wherein the further separator has a lower pressure than the separator connected to the flexible tubing.

16. The system of claim 1, further comprising a spacer arranged to urge the end of the flexible tubing against an inner wall of the riser or well.

17. The system of claim 1, further comprising a weight arranged to urge the end of the flexible tubing against an inner wall of the riser or well.

18. The system of claim 1, wherein the end of the flexible tubing is attached to an intake device, wherein the intake device is open and able to receive fluid on the side of the intake device facing the flexible tubing, and wherein the intake device is closed on the side of the intake device facing away from the flexible tubing.

19. The system of claim 1, further comprising a gas flowline terminating at or near the position where the flexible tubing terminates, wherein the gas flowline is suitable for injecting gas into the flexible tubing for providing gas lift.

20. A method for protecting a riser adapted to transport gas from a hydrocarbon production well against pressure surges or for protecting a well against pressure surges, the method comprising:

extending a portion of a flexible tubing into the riser or into the well, wherein the flexile tubing terminates inside the riser or the well, wherein an end of the flexible tubing is attached to an intake device, wherein, the intake device terminates at an end portion, the end portion of the intake device comprising a partially tubular outer wall; and the outer curvature of the partially tubular outer wall matches the inner curvature of the inside wall of the riser or well; and drawing liquid from the riser or well into the flexible tubing if liquid is present in the riser or well by creating a pressure differential within the flexible tubing with a pressure control system.

21. The method according to claim 20, wherein the surge comprises a liquid film attached to an inner wall of the riser or the well;

wherein creating the pressure differential comprises providing a pressure communication channel between the riser or the well and a first stage separator, and providing a pressure communication channel between the flexible tubing and a device with a lower pressure than the first stage separator; and wherein the method further comprises biasing the partially tubular outer wall of the end portion against the inside wall of the riser or the well.

22. The method of claim 20, wherein the method further comprises varying the length of said portion of the flexible tubing by rolling or unrolling the flexible tubing on a reel.

23. The method of claim 22, further comprising cutting the flexible tubing after said step of varying, hanging off the tubing from the riser, connecting to said pressure control system.

24. The method of claim 20, further comprising determining the pressure within the flexible tubing and varying the length depending on said determining, or adapting the pressure within the flexible tubing in response to said determining.

25. The method of claim 20, further comprising determining the amount of liquid within the flexible tubing and varying the length depending on said determining.

26. The method of claim 20, wherein said drawing of liquid comprises regulating a valve to a low pressure reservoir.

27. The method of claim 20, wherein said drawing of liquid comprising controlling a pump.

28. The method of claim 20, further comprising transporting fluid from the flexible tubing to a production facility.

29. The method of claim 20, further comprising connecting said riser or well to a first stage separator and connecting said flexible tubing to a second or higher stage separator and wherein the pressure of said second or higher stage separator is lower than the pressure of the first stage separator.

30. The method of claim 20, further comprising connecting the flexible tubing to a first flowline and connecting the well to a second flowline.

31. The method of claim 20, further comprising urging the end of the flexible tubing against an inner wall of the riser or well.

32. The method of claim 20, further comprising starting the flow of liquid into the flexible tubing at a first depth of the riser or the well, and lowering the flexible tubing to a second depth of the riser or the well, wherein the second depth is further upstream than the first depth.

33. The method of claim 20, further comprising varying the pressure with the pressure control system.

34. The method of claim 20, further providing a gas flowline and injecting gas into the flexible tubing.

* * * * *